United States Patent [19]

Chaconas

[11] 4,321,936

[45] Mar. 30, 1982

[54] NAIL POLISH REMOVER

[76] Inventor: Anthony Chaconas, 215 Lakeside Dr. T-3, Greenbelt, Md. 20770

[21] Appl. No.: 192,856

[22] Filed: Oct. 1, 1980

[51] Int. Cl.[3] ..... A45D 29/20

[52] U.S. Cl. ..... 132/75; 132/73.5

[58] Field of Search ..... 132/73.5, 75, 73, 76.4, 132/55.6; 401/127, 128, 183, 130, 198, 202; 15/167 R

[56] References Cited

U.S. PATENT DOCUMENTS

| | | | |
|---|---|---|---|
| 49,072 | 8/1865 | Boswell | 401/127 |
| 2,629,124 | 2/1953 | Morritt | 132/73 X |
| 2,703,422 | 3/1955 | Roosa | 132/75 |
| 2,736,050 | 2/1956 | Lee | 401/128 X |
| 3,316,922 | 5/1967 | Seidler | 132/75 |

*Primary Examiner*—G. E. McNeill

*Attorney, Agent, or Firm*—Sherman Levy

[57] ABSTRACT

A nail polish remover is provided that consists of a hollow container that has a quantity of fluid or liquid such as nail polish remover therein. A plurality of spaced apart fins or flexible support elements are mounted in the container, and the fins have bristles or brush-like elements secured thereto whereby a person can insert a finger into the device so that the finger will contact the bristles in such a manner that the liquid on the bristles will conveniently remove the nail polish from the fingernails.

6 Claims, 4 Drawing Figures

NAIL POLISH REMOVER

FIELD OF THE INVENTION

The present invention relates to a nail polish remover which is in the form of a unit or hollow member that has a quantity of a suitable chemical therein such as a liquid nail polish removing substance. The unit is provided with a means for facilitating the removal of the nail polish when the finger is inserted in the device and rotated or moved.

DESCRIPTION OF THE PRIOR ART

Previously, various types of nail polish removers have been provided as for example as shown in prior U.S. Pat. Nos. 1,428,564, 1,750,451, 2,494,414, 3,913,594, and 3,195,544. However, neither these prior patents nor any others known to Applicant achieve or accomplish the advantages provided by the present invention.

BACKGROUND AND SUMMARY OF INVENTION

In accordance with the present invention, there is provided a nail polish remover that includes a container that has a quantity of a suitable nail polish chemical or fluid arranged therein. The device includes a means for facilitating the insertion of a finger into the device so that by rotating or twisting the finger, the nail will be in contact with bristles that have the nail polish remover chemical thereon so that the nail polish will be conveniently removed therefrom.

An object of the present invention is to provide a nail polish remover that includes a pair of members that each have a slit therein, and wherein the slits are arranged at right angles to each other, the members being flexible so that a finger can be moved into engagement with bristles that are immersed in the nail polish removing chemical so that the nail polish can be conveniently removed from the fingernails.

A still further object of the present invention is to provide a nail polish remover that includes a cap that can be arranged on the device when the device is not being used so that accidental evaporation of the fluid will be prevented, and wherein contamination of the fluid is minimized or prevented, and wherein when the device is to be used, it is only necessary to remove or unscrew the cap so that the fingers can be inserted in the device to accomplish the desired purpose.

A still further object of the present invention is to provide a nail polish remover that is ruggedly constructed and efficient to use and which is relatively simple and inexpensive to manufacture and merchandise.

These and other objects of the invention will be apparent to others skilled in the art to which this invention pertains, and considering the following detailed description and the drawings.

DESCRIPTION OF THE PREFERRED EMBODIMENT

Figure 2:
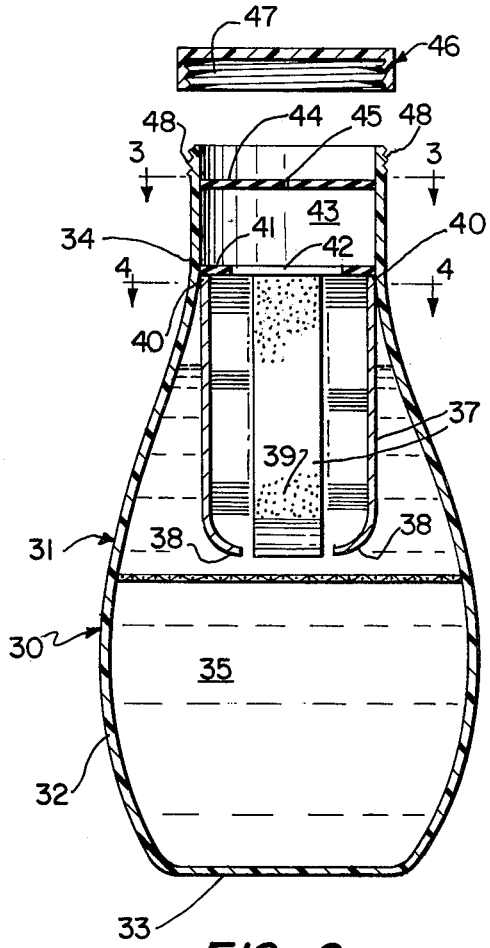
FIG. 2 is a vertical sectional view taken through the nail polish remover.
Figure 3:
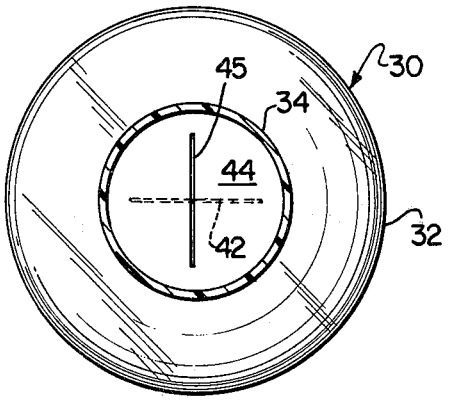
FIG. 3 is a sectional view taken of the line of 3—3 of FIG. 2.
Figure 4:
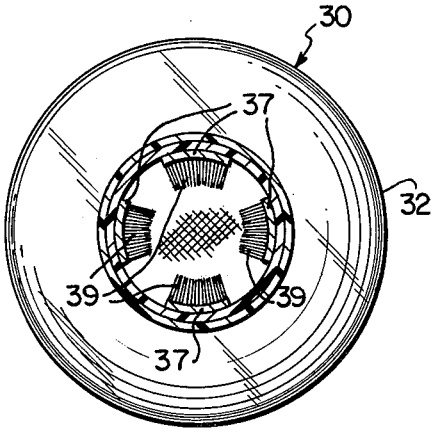
FIG. 4 is a sectional view taken on the line 4—4 of FIG. 2.

Referring in detail to the Drawings, the numeral 30 indicates the nail polish remover of the present invention which comprises a hollow container 31, that consists of a rounded body portion 32, that has a flat bottom 33, FIG. 2. A mesh screen 36 is suitably mounted within the container 31, and a quantity of nail polish remover chemical or liquid 35 is adapted to be arranged within the container 31. The container 31 further includes a reduced diameter neck portion 34.

Mounted within the container 31 is a plurality of spaced apart fins or flexible support elements 37, that have their lower or inner ends curved inwardly as 38. A plurality of flexible bristles or brush-like elements 39, are affixed to the inner surfaces of the fins 37 for a purpose to be later described. The upper ends of the fins 37 are secured in place as at 40, within the container 31.

Mounted within the neck portion 34 of the container 31, is a first flexible seal or support piece 41 that has a slit 42 therein. There is further provided a second flexible seal or support element 44 that has a slit 45 therein, and the slit 45 is arranged at right angles with respect to the slit 42. The numeral 43 indicates a space or chamber that is defined between the elements 41 and 44.

A removable cap 46 is provided for the device, and the cap 46 can include internal threads 47 for threadedly engaging external threads 48 on the neck portion of the container.

Figure 1:
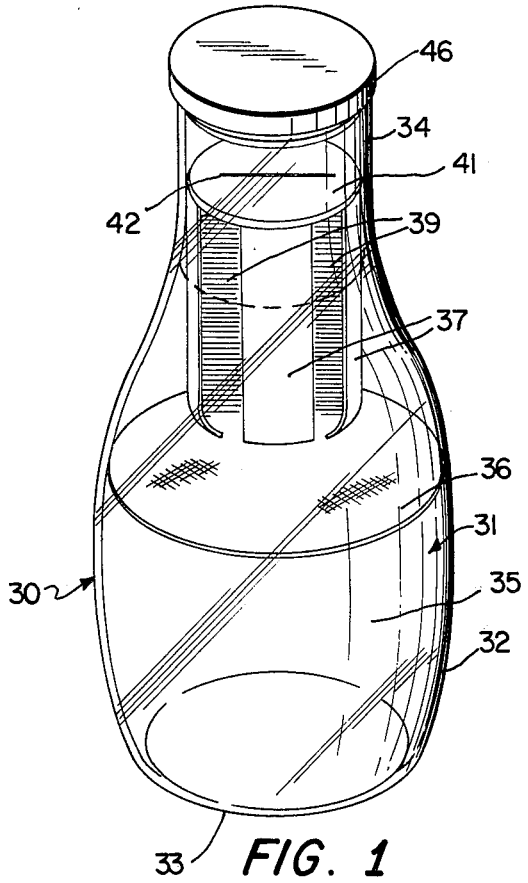
FIG. 1 is a perspective view of the nail polish remover of the present invention.

From the foregoing it will be seen that there has been provided a nail polish remover, and with the parts arranged as shown in the drawings, the container 31 is adapted to be substantially filled with a suitable quantity of nail polish removing chemical 35. Normally the cap 46 is mounted on the container 31 as shown in FIG. 1. When it is desired to remove nail polish from the fingernails or the like, it is only necessary to manually unscrew or remove the cap 46 from the container. Then, the fingers can be individually inserted through the slits 45 and 42 in the flexible members 44 and 41, so that the fingernails can contact or engage the bristles 39 that are mounted on the pins or support pieces 37. Because the bristles 39 are immersed in the fluid 35, it will be seen that by rotating or twisting the fingers, the bristles 39, having the nail polish remover chemical thereon, will cause the nail polish to be removed so that when the finger is removed from the device, the nail polish will have been removed from the fingernail. It is to be understood that the parts can be made of any suitable material, and of different shapes or sizes as desired or required.

The screen 36 is arranged as shown in the drawings. The elements 41 and 44 are made of flexible material such as plastic or rubber so that they will have sufficient resiliency to permit the fingers to be inserted through the slits or slots 45 and 42, in order to accomplish the desired results. Because the slots of 45 and 42 are arranged at right angles with respect to each other, when the finger is removed from the device, accidental removing of excess nail polish remover will be prevented. In addition, by having slots 45 and 42 at right angles to each other, a further rubbing action is provided which will increase the efficiency of the device to assure that all surfaces of the nails are contacted as, for example, by the elements 44 and 41 to remove the nail polish with maximum efficiency.

The present invention is thus in the form of a nail polish eraser or remover. The device will permit neat, easy and convenient removal of nail polish from one's fingernails. The device consists of a container of a suitable size and shape to be conveniently held in one's hand, and wherein the device holds a suitable quantity of nail polish remover. When the device is not being used, the threaded cap 46, seals and secures the top thereof.

Arranged in the upper portion of the container and extending across the same are two parallel rubber or plastic seals 44 and 41, which are arranged in space parallel with respect to each other. Each of these seals, 44 and 41, contains slits 45 and 42, which are arranged perpendicular to each other and the user is adapted to insert the finger through these slits. These double seals and perpendicular slits prevent any leakage from the container when the device is in use. Arranged below the seals, and projecting from the inside of the container are columns of suitable bristles 39, and these bristles 39 may be arranged so that certain of the bristles are shorter than others and such shorter bristles may be closer to the top of the device, and these bristles can increase in size as the columns extend further into the container.

The device is adapted to be used in the following manner. After unscrewing cap 46 and shaking up the fluid inside the container so that the bristles 39 are moistened, one inserts a polished fingernail through the double rubber seals 44 and 41, so that the fingernail comes in contact with the bristles 39. By rotating the fingernail, the moistened bristles will remove any polish from the fingernail, and this process is repeated until all polish is removed from the nail.

While several embodiments of the present invention have been illustrated herein in particular detail, it will be understood that variations and modifications may be effected without departing from the spirit and scope of the novel concepts of this invention.

What is claimed:

1. A nail polish remover comprising a hollow container including a rounded body portion, said container including a flat bottom, said container further including a reduced diameter neck portion, a mesh screen mounted in said container, fluid in said container, a plurality of spaced apart support pieces mounted in said container, said support pieces having lower inner curved ends, a plurality of flexible bristles affixed to the innr surfaces of said support pieces, a first flexible body element providing a seal mounted in said neck portion, and said body element having a slit therein, and a second flexible body element spaced from said first body element, and said second body element having a slit therein.

2. The structure as defined in claim 1, wherein said slits are arranged at right angles relative to each other.

3. The structure as defined in claim 2, and further including a cap removably mounted on the upper end of said container.

4. The structure as defined in claim 3, wherein a person's finger is adapted to be inserted through the slits and wherein by rotating the finger, the nail thereon will contact the bristles to effectively remove nail polish from the nails.

5. In a nail polish remover, hollow container means having a quantity of nail polish removing chemical therein, support means in said container means, bristle means, on said support means, a plurality of flexible seal members mounted in said container, and slit means in said seal members.

6. The structure as defined in claim 5, wherein said slit means are arranged angularly with respect to each other.

* * * * *